US010306351B2

(12) United States Patent
Kim et al.

(10) Patent No.: US 10,306,351 B2
(45) Date of Patent: May 28, 2019

(54) PORTABLE SOUND DEVICE

(71) Applicant: LG ELECTRONICS INC., Seoul (KR)

(72) Inventors: Donghan Kim, Seoul (KR); Siyoung Park, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 16/017,738

(22) Filed: Jun. 25, 2018

(65) Prior Publication Data

US 2019/0045295 A1 Feb. 7, 2019

Related U.S. Application Data

(60) Provisional application No. 62/541,075, filed on Aug. 3, 2017.

(30) Foreign Application Priority Data

Aug. 18, 2017 (KR) ..... 10-2017-0104744
Nov. 20, 2017 (KR) ..... 10-2017-0154846
Mar. 23, 2018 (KR) ..... 10-2018-0033930

(51) Int. Cl.
*H04R 1/10* (2006.01)

(52) U.S. Cl.
CPC ..... *H04R 1/1066* (2013.01); *H04R 1/10* (2013.01); *H04R 1/105* (2013.01); *H04R 1/1016* (2013.01);
(Continued)

(58) Field of Classification Search
CPC .. H04R 1/1066; H04R 1/1016; H04R 1/1033; H04R 1/105; H04R 2420/07;
(Continued)

(56) References Cited

U.S. PATENT DOCUMENTS 9,016,607 B2 4/2015 Wong et al.
9,055,364 B1 6/2015 Uh et al.
(Continued)

FOREIGN PATENT DOCUMENTS

EP 2645509 10/2013
EP 3107313 12/2016
(Continued)

OTHER PUBLICATIONS

Korean Intellectual Property Office Application No. 10-2018-0033930, Prior Art Search Report dated Apr. 4, 2018, 6 pages.
(Continued)

*Primary Examiner* — Tuan D Nguyen
(74) *Attorney, Agent, or Firm* — Lee, Hong, Degerman, Kang & Waimey

(57) ABSTRACT

A portable sound device includes: a main body having an audio output unit holder; an audio output unit detachably mountable in the audio output unit holder and configured to output audio; an audio cable coupled to the audio output unit and configured to transmit an audio signal to the audio output unit, one end of the audio cable located outside the main body and the other end of the audio cable located inside the main body; and a rotary module rotatably mounted in the main body and configured to wind or unwind the audio cable according to a rotational direction of the rotary module.

17 Claims, 14 Drawing Sheets

(52) U.S. Cl.
CPC ..... *H04R 1/1033* (2013.01); *H04R 2420/07* (2013.01)

(58) Field of Classification Search
CPC ..... B65H 75/406; B65H 75/285; B65H 75/4431; B65H 2701/3919
See application file for complete search history.

(56) References Cited

U.S. PATENT DOCUMENTS

| | | | |
|---|---|---|---|
| 9,918,155 | B2 | 3/2018 | Kim et al. |
| 2011/0139918 | A1 | 6/2011 | Chen |
| 2014/0198927 | A1 | 7/2014 | Cheng |

FOREIGN PATENT DOCUMENTS

| | | |
|---|---|---|
| EP | 3188499 | 7/2017 |
| KR | 200336095 | 12/2003 |
| KR | 101471904 | 12/2014 |
| KR | 1020160048452 | 5/2016 |
| KR | 101687623 | 12/2016 |
| KR | 1020160147687 | 12/2016 |
| KR | 101710140 | 2/2017 |
| KR | 101716870 | 3/2017 |
| KR | 101752771 | 6/2017 |
| KR | 101758285 | 7/2017 |
| KR | 1020170087035 | 7/2017 |

OTHER PUBLICATIONS

Korean Intellectual Property Office Application No. 10-2017-0154846, Office Action dated Jun. 28, 2018, 5 pages.
European Patent Office Application Serial No. 18152809.2, Search Report dated Jun. 13, 2018, 8 pages.
PCT International Application No. PCT/KR2018/005558, Notification of Transmittal of the International Search Report and the Written Opinion of the International Searching Authority, or Declaration dated Aug. 21, 2018, 11 pages.
U.S. Appl. No. 15/891,541, Office Action dated Sep. 19, 2018, 13 pages.

(a)

(b)

(a)

(b)

PORTABLE SOUND DEVICE

CROSS-REFERENCE TO RELATED APPLICATIONS

Pursuant to 35 U.S.C. § 119, this application claims the benefit of U.S. Provisional Application No. 62/541,075 filed on Aug. 3, 2017, and also claims the benefit of earlier filing dates and right of priority to Korean Patent Application Nos. 10-2017-0104744 filed on Aug. 18, 2017; 10-2017-0154846 filed on Nov. 20, 2017; and 10-2018-0033930 filed on Mar. 23, 2018, the contents of which are all hereby incorporated by reference herein in their entirety.

BACKGROUND OF THE INVENTION

Field of the Invention

The present invention relates to a portable sound (audio) device that receives a sound signal from a terminal through wireless communication with the terminal and transmits a control signal for controlling the terminal to the terminal.

Discussion of the Related Art

A portable sound device is a device that receives a sound signal from a terminal and transmits information about sound collected through a microphone to the terminal. Conventional portable sound devices use a wired mode, in which a portable sound device is connected to a terminal through an ear jack in order to receive a sound signal from the terminal. In recent years, however, the demand for a wireless communication type portable sound device has been increased due to the convenience in mobility and use thereof.

A portable sound device has an audio output module, through which music can be played and a telephone conversation can be performed. The portable sound device may be connected to a base station in order to have a telephone conversation, may be directly connected to an external server in order to acquire sound data, and may be connected to a terminal in order to perform the above functions through pairing.

Various types of portable sound devices based on the portability thereof, such as a headphone-type portable sound device, which is placed on the head of a user in the form of a hair band such that the user can carry the portable sound device, an ear-hanging type portable sound device, and an in-ear type portable sound device, have been developed.

A sound cable, which connects an earbud, which is inserted into the ear of a user to output sound, to a body, which functions as a holder, is long. When not in use, therefore, the cable may be tangled or caught on something, which is inconvenient. For this reason, a rotary module for receiving the sound cable in the body may be provided.

SUMMARY OF THE INVENTION

Accordingly, the present invention is directed to a portable sound device that substantially obviates one or more problems due to limitations and disadvantages of the related art.

An object of the present invention is to provide a portable sound device that receives a sound signal from a terminal through wireless communication with the terminal and transmits a control signal for controlling the terminal to the terminal, wherein a number of members constituting a rotary module is reduced, whereby the portable sound device has a compact structure.

Additional advantages, objects, and features of the invention will be set forth in part in the description which follows and in part will become apparent to those having ordinary skill in the art upon examination of the following or may be learned from practice of the invention. The objectives and other advantages of the invention may be realized and attained by the structure particularly pointed out in the written description and claims hereof as well as the appended drawings.

To achieve these objects and other advantages and in accordance with the purpose of the invention, as embodied and broadly described herein, a portable sound device includes: a main body having an audio output unit holder; an audio output unit detachably mountable in the audio output unit holder and configured to output audio; an audio cable coupled to the audio output unit and configured to transmit an audio signal to the audio output unit, one end of the audio cable located outside the main body and the other end of the audio cable located inside the main body; and a rotary module rotatably mounted in the main body and configured to wind or unwind the audio cable according to a rotational direction of the rotary module.

According to one aspect of the present invention, the rotary module includes: a stationary unit fixed to the main body, the stationary unit comprising a shaft; a rotary unit configured to be rotatable about the shaft, the rotary unit comprising a track; and a stopper inserted into the track such that a position of the stopper varies in the track when the rotary unit is rotated. Further, the track includes: a first track formed around the shaft such that a distance of the first track from the shaft is inconsistent; a second track located outside the first track; a connection track interconnecting the first track and the second track; and a stop track located between the first track and the second track.

According to an embodiment of the present invention, a portable sound device includes: a main body having an audio output unit holder; an audio output unit detachably mountable in the audio output unit holder and configured to output audio; an audio cable coupled to the audio output unit and configured to transmit an audio signal to the audio output unit, one end of the audio cable located outside the main body and the other end of the audio cable located inside the main body; and a rotary module rotatably mounted in the main body and configured to wind or unwind the audio cable according to a rotational direction of the rotary module, the rotary module including: a stationary unit fixed to the main body, the stationary unit comprising a shaft; a rotary unit configured to be rotatable about the shaft, the rotary unit comprising a track; and a stopper inserted into the track such that a position of the stopper varies in the track when the rotary unit is rotated, and the track including: a first track formed around the shaft such that a distance of the first track from the shaft is inconsistent; a second track located outside the first track; a connection track interconnecting the first track and the second track; and a stop track located between the first track and the second track.

It is to be understood that both the foregoing general description and the following detailed description of the present invention are exemplary and explanatory and are intended to provide further explanation of the invention as claimed.

BRIEF DESCRIPTION OF THE DRAWINGS

The present invention will become more fully understood from the detailed description given herein below and the accompanying drawings, which are given by illustration only, and thus are not limitative of the present invention, and wherein.

DETAILED DESCRIPTION OF THE INVENTION

Description will now be given in detail according to exemplary embodiments disclosed herein, with reference to the accompanying drawings. For the sake of brief description with reference to the drawings, the same or equivalent components may be provided with the same reference numbers, and description thereof will not be repeated. In general, a suffix such as "module" and "unit" may be used to refer to elements or components. Use of such a suffix herein is merely intended to facilitate description of the specification, and the suffix itself is not intended to give any special meaning or function. In the present disclosure, that which is well-known to one of ordinary skill in the relevant art has generally been omitted for the sake of brevity. The accompanying drawings are used to help easily understand various technical features and it should be understood that the embodiments presented herein are not limited by the accompanying drawings. As such, the present disclosure should be construed to extend to any alterations, equivalents and substitutes in addition to those which are particularly set out in the accompanying drawings.

It will be understood that although the terms first, second, etc. may be used herein to describe various elements, these elements should not be limited by these terms. These terms are generally only used to distinguish one element from another.

It will be understood that when an element is referred to as being "connected with" another element, the element can be directly connected with the other element or intervening elements may also be present. In contrast, when an element is referred to as being "directly connected with" another element, there are no intervening elements present.

A singular representation may include a plural representation unless it represents a definitely different meaning from the context.

Terms such as "include" or "has" are used herein and should be understood that they are intended to indicate an existence of several components, functions or steps, disclosed in the specification, and it is also understood that greater or fewer components, functions, or steps may likewise be utilized.

Figure 1:
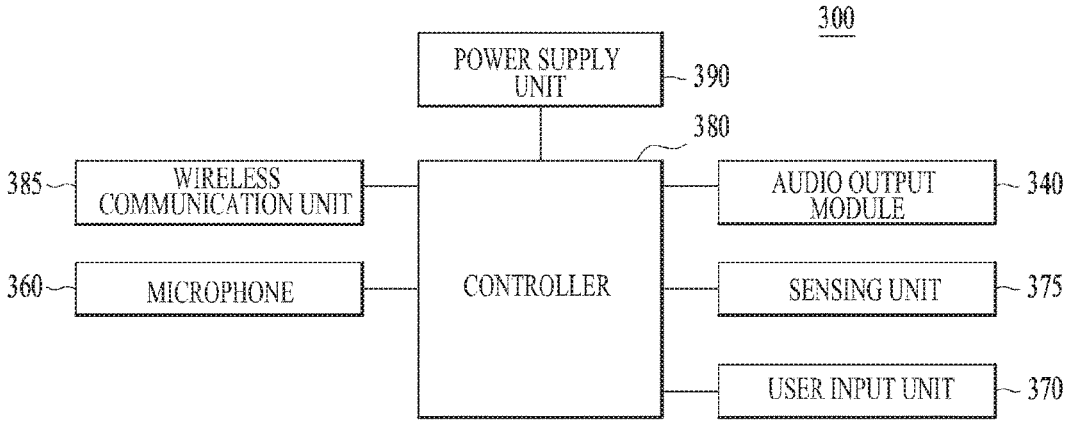
FIG. 1 is a block diagram showing the structure of a portable sound device according to an embodiment of the present invention.
Figure 2:
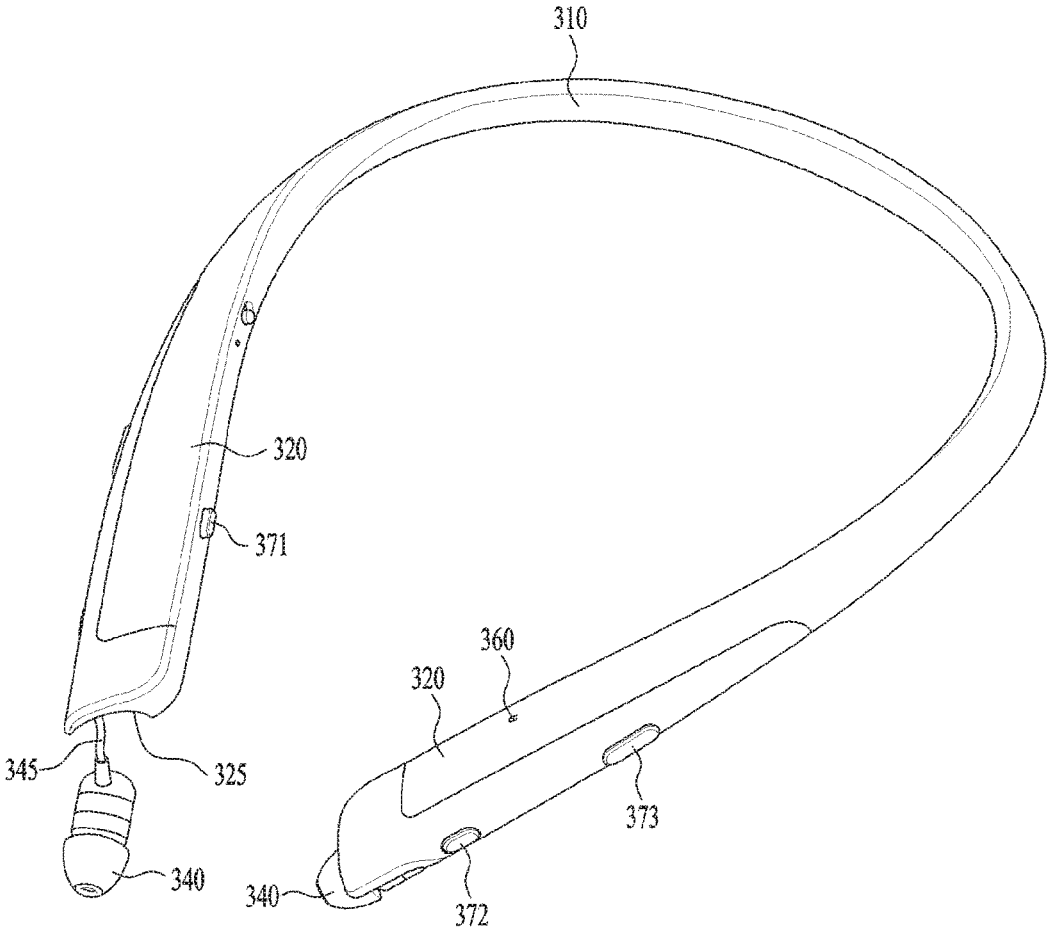
FIG. 2 is a perspective view of the portable sound device according to an embodiment of the present invention.

FIG. 1 is a block diagram of a portable sound device 300 according to an embodiment of the present invention. FIG. 2 is a perspective view of the portable sound device 300 according to an embodiment of the present invention. For convenience in describing the structure of the portable sound device 300 shown in FIG. 1, reference is also to be made to FIG. 2.

The portable sound device 300 according to an embodiment of the present invention includes a controller 380, a wireless communication unit 385, an audio output module 340, a sensing unit 375, a microphone 360, a user input unit 370, and a power supply unit 390.

The audio output module 340 outputs sound according to a sound signal. A representative example of the audio output module 340 is an earbud, which is inserted into an ear of a user in order to transmit sound to the ear.

The microphone 360 processes an external sound signal into electrical voice data. The processed voice data is transmitted to an external terminal or an external server via the wireless communication unit 385. The microphone 360 may use various noise removal algorithms for removing noise generate when receiving an external sound signal.

The sensing unit 375 recognizes the state of the portable sound device 300 and the surroundings of the portable sound device 300. The sensing unit 375 may include an illuminance sensor for sensing brightness around the portable sound device 300, a touch sensor for sensing a touch input, a gyro sensor for sensing the tilt and position of the portable sound device 300, and an earbud switch for sensing whether the earbud 340 is located in an earbud holder 325.

The user input unit 370 allows a user to control the portable sound device 300. An example of the user input unit 370 may include a talk button 372, a volume button 373, a power button 371, and a reception button for receiving a sound cable or audio cable 345 in a housing 320.

The user input unit 370 may include only a talk button 372 and a pair of volume buttons 373. In addition, the user input unit 370 may include a play/stop button and a sequence change button. The size of the portable sound device 300 is limited, and the user may push the user input unit 370 without looking thereat. If the number of buttons is large, it would be difficult for the user to distinguish between the buttons. For this reason, a limited number of buttons is used. In this case, the amount of time for which the buttons are pushed and the number of times that the buttons are pushed may be varied, and a plurality of buttons may be combined to input various control commands.

Since the user carries the portable sound device 300, the possibility of losing the portable sound device 300 is low. However, generally, terminals may be lost. For this reason, the user input unit 370 may perform an alarm function. For example, two buttons of the user input unit 370 may be simultaneously pushed for a predetermined amount of time. In this case, a lost terminal connected to the portable sound device through BLUETOOTH™ may sound an alarm, whereby the lost terminal may be easily found.

In addition, a voice recording function of an external terminal connected to the portable sound device through BLUETOOTH™ may be activated to store voices collected through the microphone 360 of the portable sound device 300.

Only functions related to conversation and functions related to playback of sound media are controllable using a conventional portable sound device. However, the portable sound device according to the present invention is characterized in that the portable sound device has diversified functions.

FIG. 2 is a perspective view of the portable sound device 300 according to an embodiment of the present invention when viewed in one direction. A main body of the portable sound device 300 according to an embodiment of the present invention includes an elastic band 310 and a housing 320. As shown in FIG. 2, the main body is curved in the shape of a C.

The housing 320, in which electronic parts are received, is provided at each end of the elastic band 310, which is placed on the neck of the user. The elastic band 310 and the housing 320 are partitioned based on the functions of the portable sound device. Consequently, the elastic band 310 and the housing 320 may be integrally formed, or may overlap each other.

The elastic band 310 has elasticity so as to be deformed within a predetermined range when force is applied thereto and to return to the original state thereof when the force is removed. If the distance between the opposite housings 320 is not sufficient for the neck of the user to pass between the housings 320, the housings 320 may be spaced apart from each other due to the elasticity of the elastic band 310 such that the elastic band 310 is placed on the neck of the user or removed from the neck of the user.

The shape and length of the elastic band 310 are set so as to minimize a foreign-body sensation when the elastic band 310 is placed on the neck of the user. For example, the elastic band 310 may be formed in the shape of a curved cylinder or a twisted tape having surfaces and a thickness. If the elastic band 310 is formed in the shape of a twisted tape, the inner surface of the elastic band 310 is placed on the rear of the neck of the user, and the outer surface of the elastic band 310 faces the rear of the neck of the user. The connection between the elastic band 310 and each housing 320 may be twisted such that the outer surface of each housing faces the front or the top of the user and the inner surface of each housing faces the rear or the collarbone of the user.

Housings 320 are coupled to the opposite ends of the elastic band 310 so as to be located at opposite ends of the C-shaped portable sound device 300. Inside and outside the housings 320 are disposed various components, such as a main board 381, the wireless communication unit 385, a battery 391, and a rotary module 350.

Figure 3:
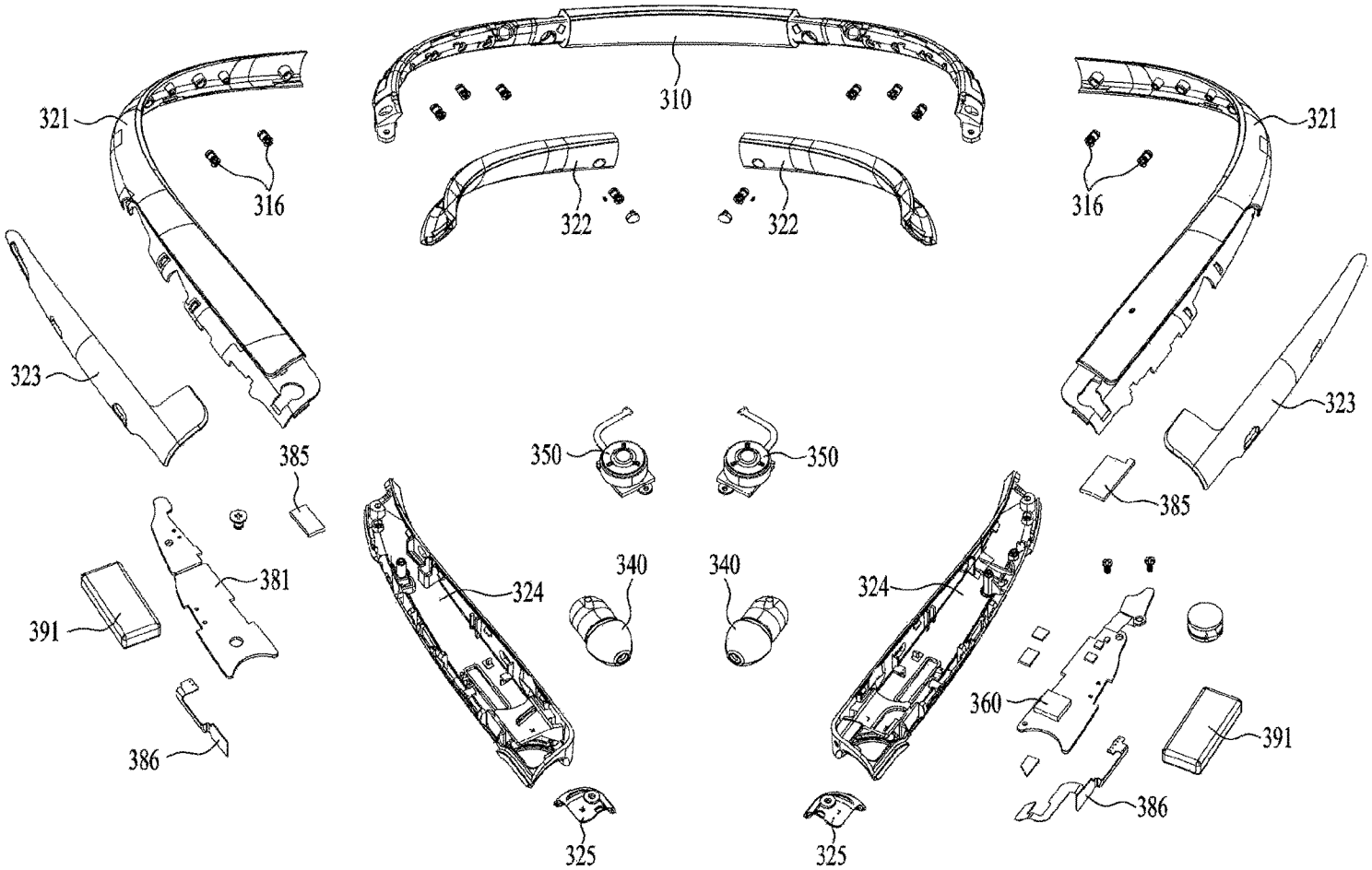
FIG. 3 is an exploded perspective view of the portable sound device according to an embodiment of the present invention.

As shown in FIG. 3, the C-shaped portable sound device 300 may be carried while being placed on the neck of the user. At this time, the sensing unit 375 may sense whether the user is wearing the portable sound device 300. For example, the sensing unit 375 may be a displacement sensor located at the elastic band 310 for sensing a change in the curvature of the elastic band 310. The displacement sensor may sense whether the housings 320 are spaced apart from each other when the user puts on the portable sound device 300. In this case, the curvature of the elastic band 310 is gently changed. Consequently, it may be determined that the user will use the portable sound device 300, and the portable sound device 300 may be powered on, or the portable sound device 300 may be synchronized with an external terminal.

In order to more accurately determine whether the user wears the portable sound device 300 or the housings 320 have been spaced apart from each other while the user is carrying the portable sound device, additional curvature of the elastic band 310 after the curvature of the elastic band 310 has been greatly changed may also be considered. When the curvature of the elastic band 310 is greatly changed to a first size and then is fixed to a second size, which is less curved than the state in which the portable sound device 300 remains unused, it may be determined that the portable sound device 300 has been placed on the neck of the user.

In addition to the displacement sensor, a temperature sensor, an optical sensor, or a heartbeat sensor may be provided at the surface of the portable sound device that comes into contact with the neck of the user when the user puts on the portable sound device 300. When the body temperature is sensed, when brightness around the portable sound device is reduced, or when a heartbeat is sensed, it may be determined that the user is wearing the portable sound device, and the portable sound device 300 may be powered on, or the wireless communication unit 385 may be activated for synchronization with an external terminal.

Alternatively, a switch configured to be physically pushed may be used. When the user wears the portable sound device 300, the switch may be pushed to generate an ON signal. When the switch remains on for a predetermined amount of time or more, the portable sound device 300 may be powered on, or may be synchronized with an external terminal.

The sensing unit 375 may include a plurality of switches. In this case, a plurality of values may be combined to correctly determine whether the user is wearing the portable sound device 300.

FIG. 3 is an exploded perspective view of the portable sound device 300 according to an embodiment of the present invention.

Each of the housings 320, coupled to opposite ends of the elastic band 310, includes an upper case 321 and a lower case 324. Between the upper case 321 and the lower case 324 are mounted the main board 381, the wireless communication unit 385, the battery 391, the microphone 360, and the rotary module 350.

The housings 320 are manufactured by injection-molding a polymer material. For example, the housings 320 may be made of plastic, such as polystyrene (PS). The housings 320 may partially include a different material, such as metal, glass, or leather, in a portion thereof.

The housings 320 are made of polystyrene, which exhibits high rigidity, in order to protect the components therein. In addition, the surfaces of the housings 320 may be coated with polyurethane such that the housings can come into tight contact with the body of the user. When the surfaces of the housings 320 are coated with polyurethane, the portable sound device 300 may have an external appearance that provides a sense of unity. Since the elastic band 310 and the housings 320 come into tight contact with the skin of the user, the portable sound device 300 does not shake when the user moves, whereby the wearing sensation is improved.

The portable sound device 300, which is placed on the body of the user, is easily exposed to moisture, such as sweat. For this reason, the portable sound device 300 has a waterproofing function in order to improve the durability thereof. A rib or a waterproofing member may be interposed in the gap between the upper case 321 and the lower case 324 in order to prevent water from permeating therethrough. Even though a separate waterproofing member is not provided, the upper case 321 and the lower case 324 may come into tight contact with each other through polyurethane coating.

The wireless communication unit 385 and the microphone 360 are mounted on the main board 381, which is mounted in one of the housings 320, and are connected to the battery 391, the user input unit 370, and the audio output module 340. The components mounted in the housings 320 may be disposed symmetrically or asymmetrically. Only the components mounted in one of the housings 320 may be used through a signal cable mounted in the elastic band 310. For example, in the case in which the wireless communication unit 385 is mounted in one of the housings 320, a sound signal received by the wireless communication unit 385 may be transmitted to the earbuds 340 via the signal cable.

The wireless communication unit 385 may include an antenna pattern 386 mounted on the main board 381 or formed on the surfaces of the housings 320 for transmitting and receiving a signal to and from an external terminal. The wireless communication unit 385 is synchronized with an external terminal using a short-distance wireless communication system, such as BLUETOOTH™, in order to receive a control signal and a sound signal from the external terminal, or transmits a control signal and a sound signal input through the user input unit 370 or the microphone 360 of the portable sound device 300 to the external terminal.

The power button 371, which is used to turn power on/off, the talk button 372, which is used for play or conversation, and the direction key for the volume button 373, which is used to control sound, may be included in the housings 320. (The direction key may also be used to perform control to play the previous track or the next track.) A dome key that is physically pushed or a touch key that senses a change of capacitance may be used as each button.

The position of the touch key is not limited, and the surfaces of the housings 320 may be variously used. When the touch key is formed on the surfaces of the housings 320, the position and function of the touch key may be displayed on the portions of the surfaces of the housings 320 at which the touch key is formed using LEDs.

The earbuds 340 are inserted into the ears of the user to transmit sound to the user. The earbuds 340 are connected to the main board 381 via the sound cable 345 shown in FIG. 6. A sound output module (not shown) may perform a function of directly generating sound in the earbuds 340. The sound output module may include a vibrating plate.

The main board 381 controls the earbuds 340 so as to output sound according to a sound signal.

Figure 4:
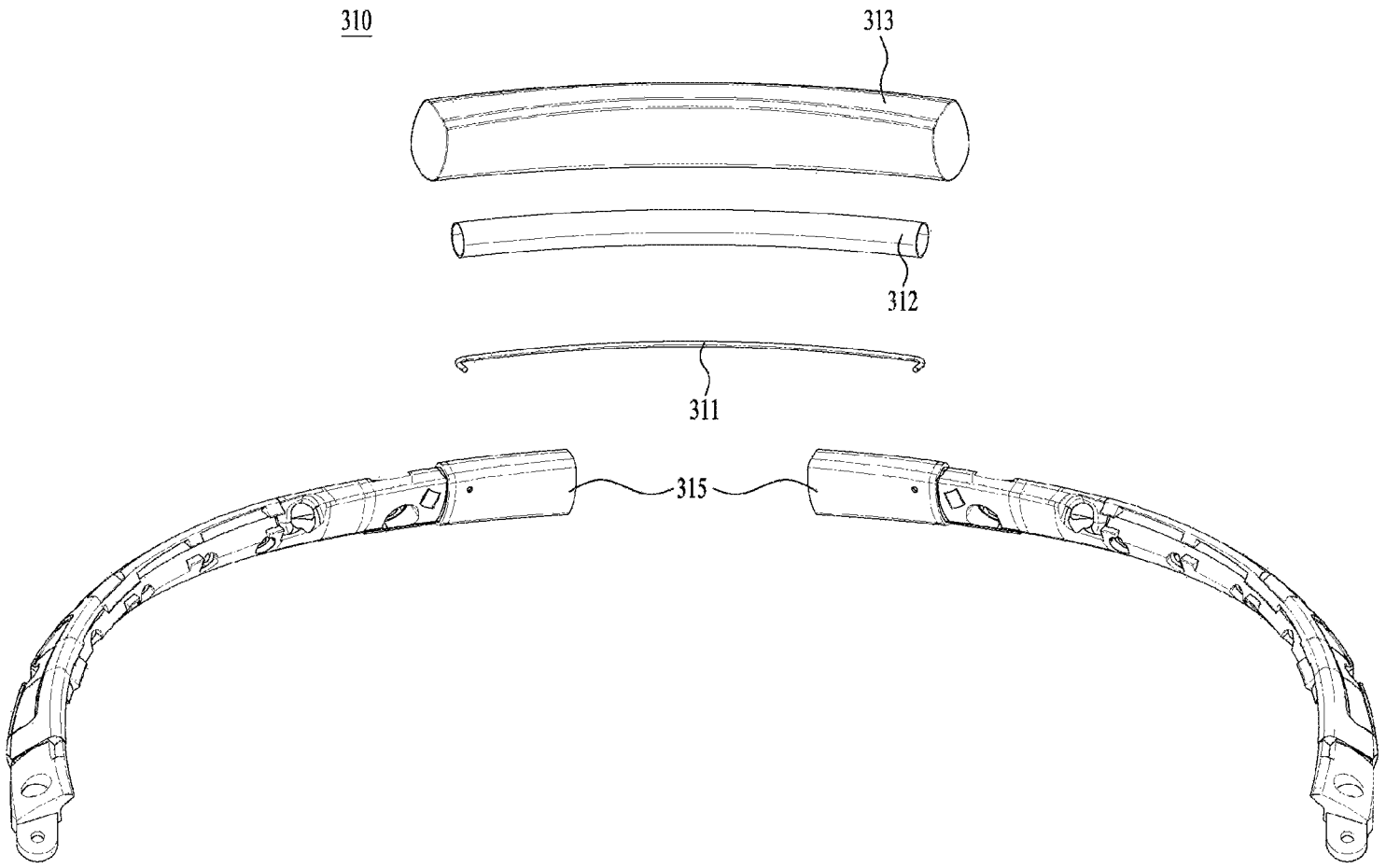
FIG. 4 is an exploded perspective view of an elastic band of the portable sound device according to an embodiment of the present invention.

FIG. 4 is an exploded perspective view of an elastic band 310 of a portable sound device 300 according to another embodiment of the present invention. The elastic band 310 includes a shape memory alloy 311, covering units 312 and 313, and connection units 315.

The shape memory alloy 311 returns to a specific shape when deformed. When the elastic band 310 is deformed as the main body is widened by the user, the shape memory alloy 311 returns to the original shape thereof. Consequently, deformation of or damage to the portable sound device 300 is prevented.

The covering units 312 and 313 cover the shape memory alloy 311. The covering units 312 and 313 may be made of thermoplastic polyurethane, the shape of which is variable. Thermoplastic polyurethane is melted by heat, and has the same elasticity as rubber, and is resistant to oil and wear after hardening.

The connection units 315 have fastening structures configured to be coupled to the housings 320, which are located at opposite ends of the elastic band 310. The connection units 315 extend leftward and rightward from the covering units 312 and 313 so as to overlap the housings 320, and are coupled to the covering units 312 and 313 so as to be covered by the covering units 312 and 313. That is, the covering units 312 and 313 are formed on the shape memory alloy 311 and the connection units 315 by double injection.

The second covering unit 312 covers the shape memory alloy 311 and the signal cable so as to accurately dispose the shape memory alloy 311 at the connection units 315 and to fix the signal cable, which transmits and receives a signal to or from the housings 320. The opposite ends of the second covering unit 312 are coupled to the respective connection units 315. Subsequently, the first covering unit 313, which covers the connection units 315, the second covering unit 312, and the shape memory alloy 311, is formed by double injection. As a result, the elastic band 310 is configured to be easily deformed when the user wears the portable sound device and to return to the original shape thereof.

Figure 5:
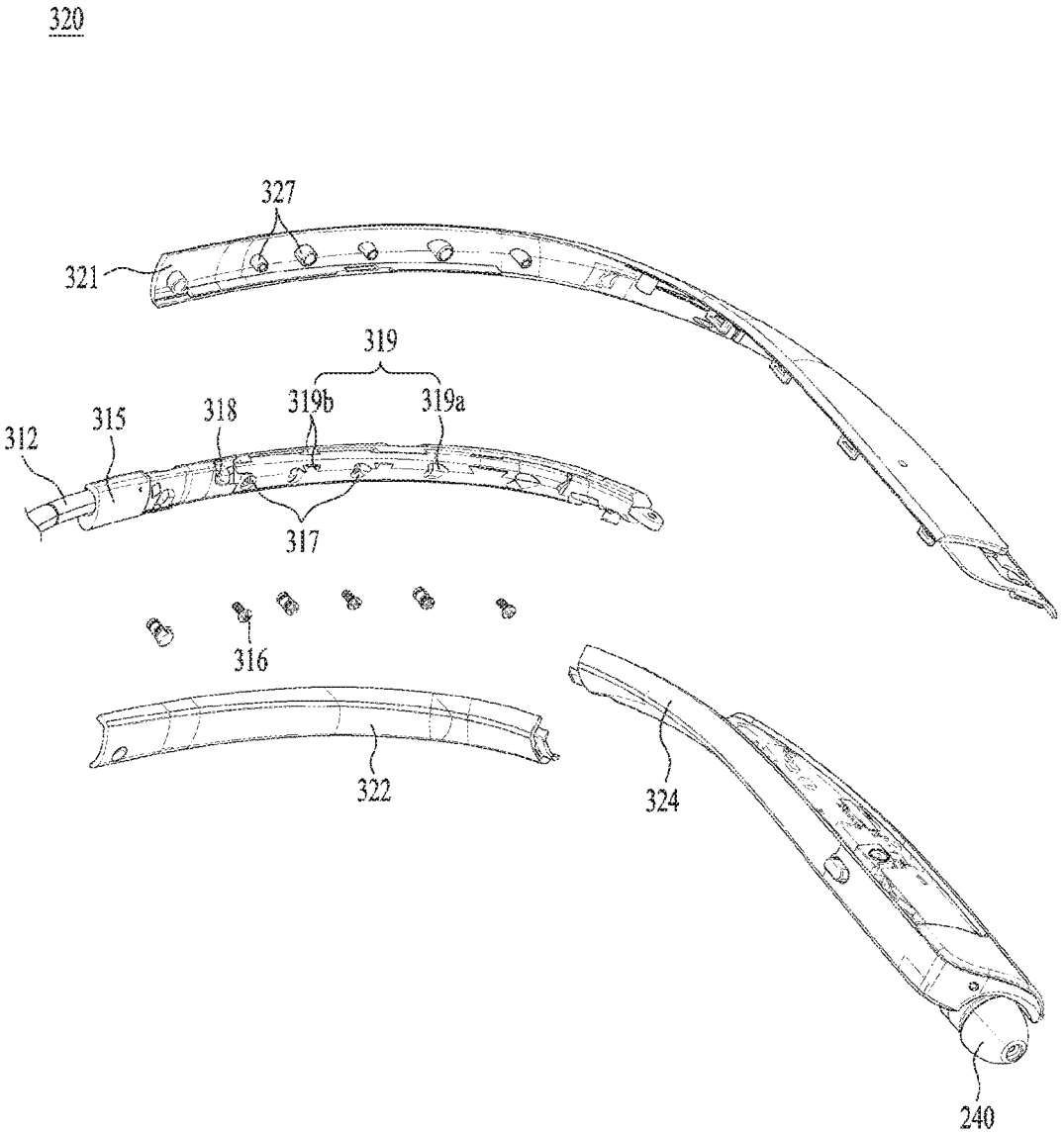
FIG. 5 is a view showing coupling between a housing and the elastic band of the portable sound device according to an embodiment of the present invention.

FIG. 5 is a view showing coupling between the elastic band 310 and the housing 320 of the portable sound device 300 according to an embodiment of the present invention. The shape memory alloy 311 (see FIG. 4) is exposed from the opposite ends of the second covering unit 312. In order to increase fixing force, the opposite ends of the shape memory alloy 311 (see FIG. 4) may be bent in the form of a hook so as to be connected to the connection units 315. Each connection unit 315 is provided with a plurality of holes, through which each connection unit 315 is fastened to a corresponding one of the housings 320.

At least a portion of each connection unit 315 may be surrounded by a corresponding one of the housings 320. An upper case 321 and lower cases 322 and 324 may cover one surface and the other surface of at least a portion of each connection unit 315, respectively. The upper case 321 is exposed outward. For this reason, the upper case 321 is formed of a single member that extends from the portions of the elastic band 310 that are coupled to the connection units 315 to the opposite ends of the main body. As shown in FIG. 5, the lower cases 322 and 324 may include a first lower case 322, which surrounds a corresponding one of the connection units 315, and a second lower case 324, in which components are mounted.

The upper case 321 or one of the lower cases 322 and 324 and a corresponding one of the connection units 315 are coupled to each other by screws 316, which are fastened to the upper case 321 or one of the lower cases 322 and 324 through fastening holes formed in the connection unit 315. The portion of the case from which the heads of the screws 316 are exposed may be covered by coupling between the case and the opposite case.

The length of each connection unit 315 may be set as needed. In order to secure space and to reduce the weight of the portable sound device 300, each connection unit 315 may be formed so as to be short such that the minimum number of screws 316 is used. In this case, however, the fastening force between the elastic band 310 and the housings 320 is low. When force is repeatedly applied to the elastic band 310, therefore, the elastic band may be damaged. Consequently, each connection unit 315 may be extended far enough to increase fastening force using the maximum number of screws 316.

Figure 6:
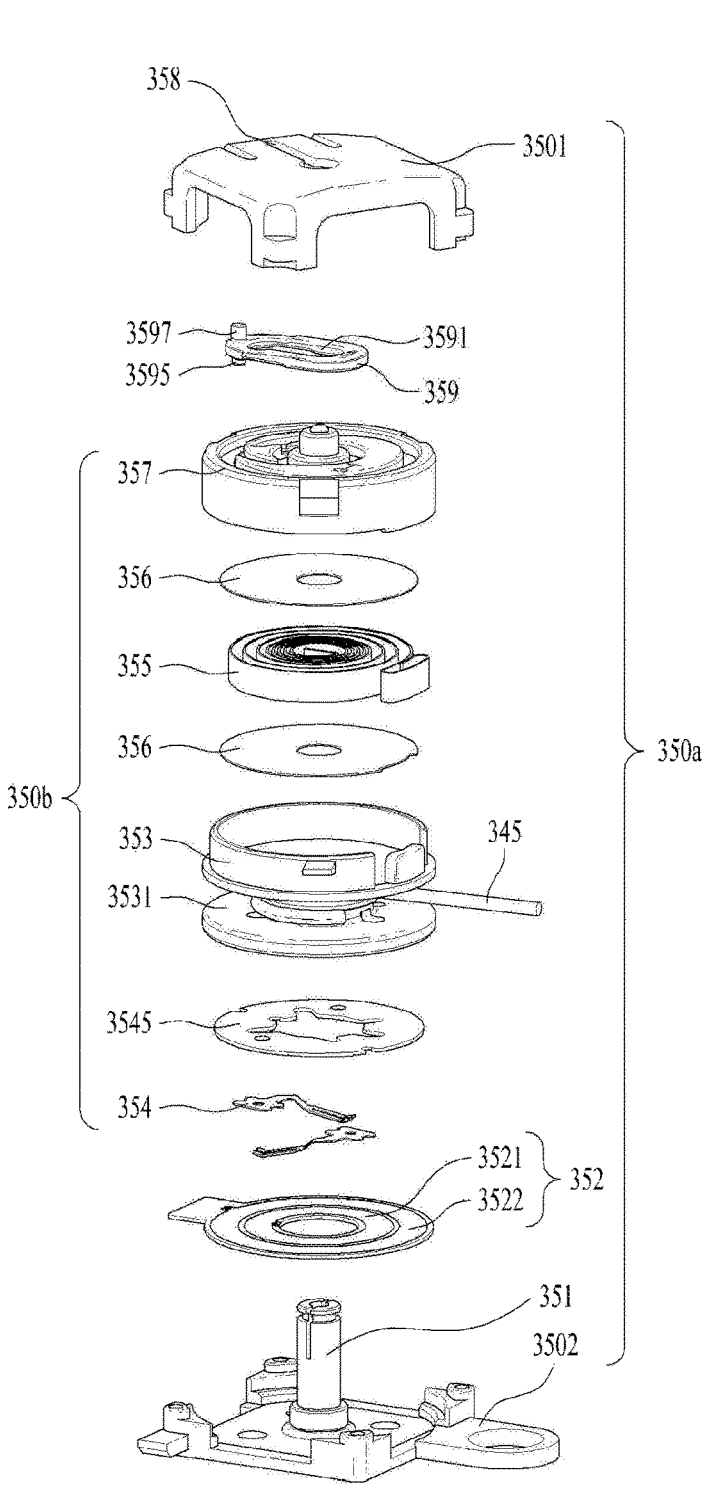
FIG. 6 is an exploded perspective view of a rotary module of the portable sound device according to an embodiment of the present invention.

FIG. 6 is an exploded perspective view of the rotary module 350 of the portable sound device according to an embodiment of the present invention.

The rotary module 350 is rotatably mounted in each housing 320. When the rotary module 350 is rotated, the sound cable 345 is wound around the rotary module 350 such that the sound cable 345 is received in each housing 320 (see FIG. 3). The earbuds 340 (see FIG. 3) are fastened to the respective earbud holders (see FIG. 2). The rotary module 350 includes a stationary unit 350*a*, which is fixed to the housing 320, and a rotary unit 350*b* configured to be rotatable relative to the stationary unit 350*a*. The stationary unit 350*a* may further include brackets 3501 and 3502, which define the external appearance of the rotary module 350.

The stationary unit 350*a* includes a shaft 351, which serves as the axis of rotation of the rotary module 350, and the rotary unit 350*b* includes a cylindrical bobbin 353, around which the sound cable 345 is wound. The bobbin 353 may include a concave part 3531, which is recessed toward the center thereof to provide a space in which the sound cable 345 is wound.

A reel spring 355 is provided in the bobbin 353 to provide the force necessary to rotate the rotary module 350. The reel spring 355 is a kind of leaf spring that is spirally wound. The inside end of the reel spring 355 is fixed to the shaft 351, and the outside end of the reel spring 355 is coupled to the rotary unit 350*b*. When the user pulls the sound cable 345, the bobbin 353 is rotated in a first direction (the counterclockwise direction in the drawing). As a result, the number of windings of the reel spring 355 is reduced, whereby the reel spring 355 has elastic restoring force. When the user releases the sound cable 345, the reel spring 355 is rotated in a second direction (the clockwise direction in the drawing), which is opposite the first direction, due to the restoring force thereof. As a result, the sound cable 345 is wound around the bobbin 353, whereby the sound cable 345 is received in the housing 320.

Even when the rotary unit 350*b* is rotated, the sound cable 345 must be connected to the main board 381 mounted in the housing 320. To this end, the stationary unit 350*a* includes a rotary module board 352, which is connected to the main board 381. The rotary module board 352 includes two electrodes 3521 and 3522 having different diameters. Connection terminals 354, which are connected to the electrodes 3521 and 3522, are located in the rotary unit 350*b*. The connection terminals 354 are connected to the sound cable 345. Even when the rotary unit 250*b* is rotated, the connection terminals 354 remain connected to the electrodes 3521 and 3522. An auxiliary board 3545 may be further included to prevent the connection terminals 354 from being separated from the electrodes 3521 and 3522 and to connect the connection terminals 354 to the sound cable 345 by soldering.

A stop module for controlling the rotation of the rotary unit 350*b* in the second direction due to the elasticity of the reel spring 355 may be further included. The stop module does not disturb the rotation of the rotary unit 350*b* in the first direction when the user pulls the sound cable 345. Consequently, the sound cable is drawn out while the rotary unit 350*b* is smoothly rotated as the user pulls the sound cable 345. When the user releases the sound cable 345 after drawing out the sound cable 345, the stop module prevents the rotation of the rotary unit 350*b* in the second direction so as to fix the rotary unit 350*b* such that the sound cable 345 is not inserted into the housing 320 in the state of being drawn out.

When the sound cable 345 is pulled again and released, the fixed state of the rotary unit 350*b* is released, and the rotary unit 350*b* is rotated in the second direction due to the elasticity of the reel spring 355. As a result, the sound cable 345 is inserted into the housing.

The stop module may control winding and unwinding of the sound cable 345 on and from the rotary unit 350*b* merely through a pulling operation by improving a conventional structure in which the rotation of the rotary unit 350*b* is fixed by a member such as a hook and the fixed state of the rotary unit 350*b* is released by a button.

The stop module includes a track module 357 having a track formed concavely in the shape of a groove and a stopper 3595 configured to move on the track when the track module 357 is rotated. The stopper 3595 may be formed in the shape of a ball or a pogo pin. As shown in FIG. 6, the stopper 3595 may protrude from a stop plate 359.

The stationary unit 350*a* is fixed to the housing 320, whereby the stationary unit 350*a* is not movable, and the rotary unit 350*b* is rotated about the shaft 351. However, the stopper 3595 moves rectilinearly in the diametric direction of the rotary unit 350*b*.

Figure 7:
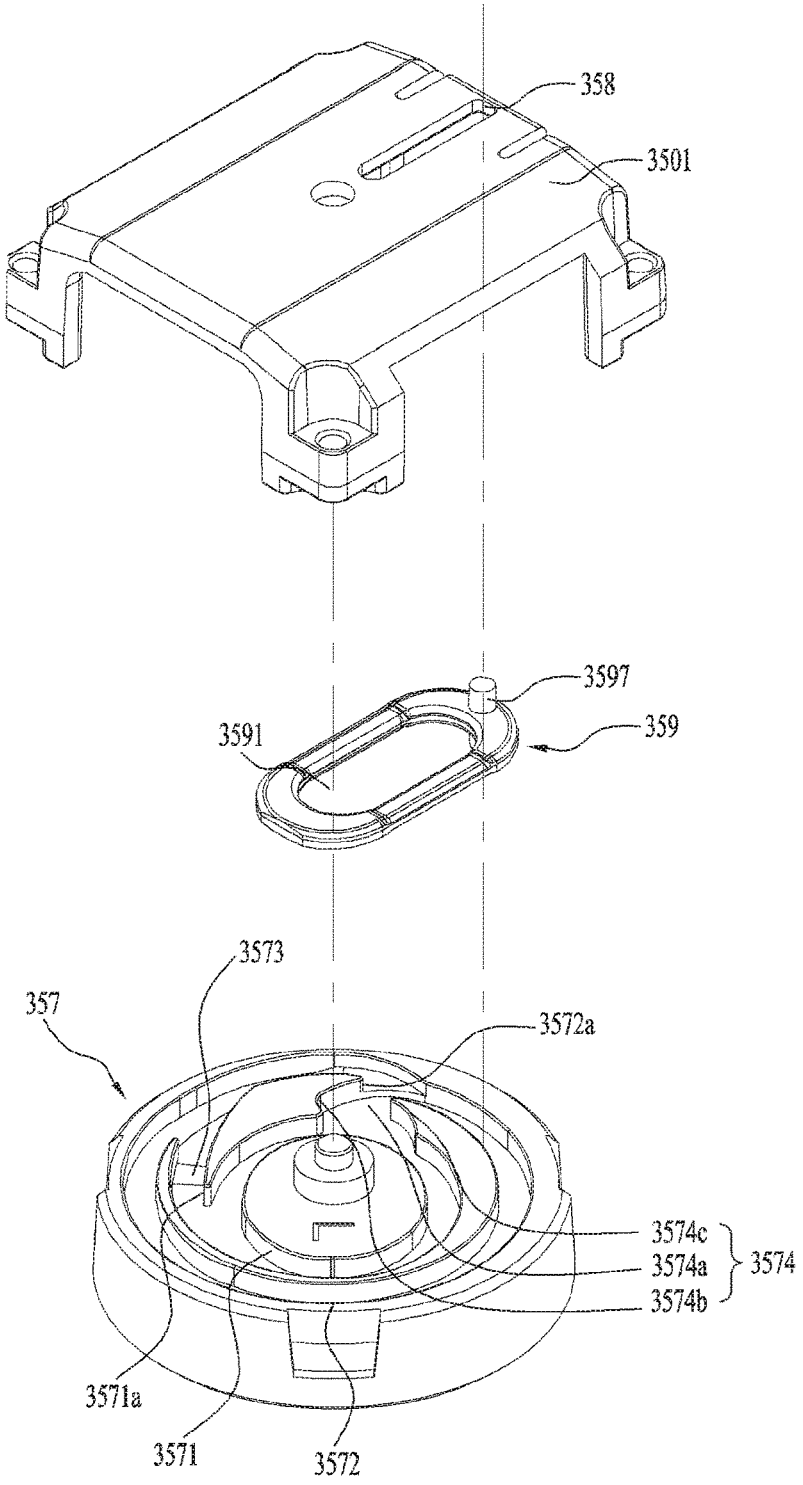
FIG. 7 is an exploded perspective view showing a track, a bracket, and a stop plate of the portable sound device according to an embodiment of the present invention.

FIG. 7 shows the stop module. The stop module may include a track module 357 and a stop plate 359, which includes a shaft slot 3591 and a stopper 3595 (shown in FIG. 6). The track module 357, which is a portion of the rotary unit 350*b*, moves with the bobbin 353. The stop plate 359 moves rectilinearly when the rotary unit 350*b* is rotated.

Figure 8:
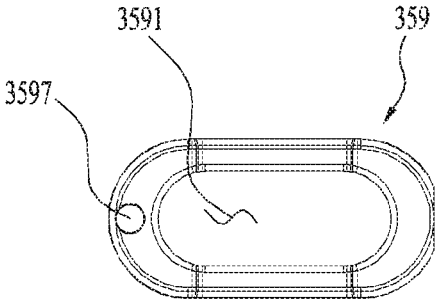
FIG. 8 is a view showing the stop plate according to an embodiment of the present invention.
Figure 8:
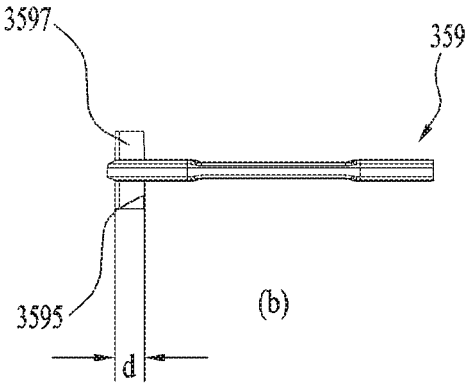

The stop plate 359, which is a plate-shaped member, is made of an injection-molded material or a plate-shaped metal material. FIG. 8 is a plan view and a side view showing the stop plate according to an embodiment of the present invention. The stop plate 359 is provided with a shaft slot 3591, a stopper 3595, and a guide boss 3597. The shaft slot 3591 is an opening formed in the stop plate 359 so as to extend to one side thereof. The shaft 351 extends through the shaft slot 3591.

The width of the shaft slot 3591 corresponds to the width of the shaft 351, and the shaft slot 3591 extends to one side thereof so as to be longer than the diameter of the shaft 351. The length of the shaft slot 3591 corresponds to a difference in the diameter between a first track 3571 and a second track 3572 of the track, a description of which will follow.

The stopper 3595 is a protrusion that protrudes from the stop plate 359 toward the track module 357. The stopper 3595 may be formed so as to have a shape corresponding to the section of the track. The concave track surface of the track may have a shape corresponding to the shape of the stopper 3595.

The guide boss 3597 protrudes in the direction opposite the direction in which the stopper 3595 protrudes. The guide boss 3597 is inserted into a guide slot 358 formed in the bracket 3501. As shown in FIG. 6, the guide slot 358 may be formed in the shape of a groove extending in the direction parallel to the direction in which the shaft slot 3591 extends.

If the guide boss 3597 and the guide slot 358 are not provided, the stop plate 359 does not move rectilinearly but is rotated with the rotary unit 350*b*. In order to solve this problem, the rotation of the stop plate 359 may be prevented and the rectilinear movement of the stop plate 359 toward the shaft slot 3591 may be assisted through the guide slot 358 formed in the bracket 3501, which is a stationary unit.

As shown in FIG. 8(*b*), the guide boss 3597 and the stopper 3595 may be formed symmetrically. In the case in which the guide boss 3597 and the stopper 3595 are formed symmetrically, one surface and the other surface of the stop plate 359 are not distinguished from each other. At the time of assembly, therefore, defects due to overturning of the stop plate 359 may be reduced, whereby assembly efficiency may be improved and thus the incidence of assembly defects may be reduced.

The track module 357 according to an embodiment of the present invention includes a track formed concavely in the shape of a groove. The stopper 3595 may move along the track. The stop plate 359 moves depending on the position of the stopper 3595 on the track module 357. The shaft slot 3591 in the stop plate 359 is not rotated but moves rectilinearly. The track module 357 is located on the bobbin 353, which is a component of the rotary unit 350*b*, so as to be rotatable with the rotary unit 350*b* when the rotary unit 350*b* is rotated. The stop plate 359 moves rectilinearly depending on the position of the stopper 3595 on the track when the track module 357 is rotated.

Figure 9:
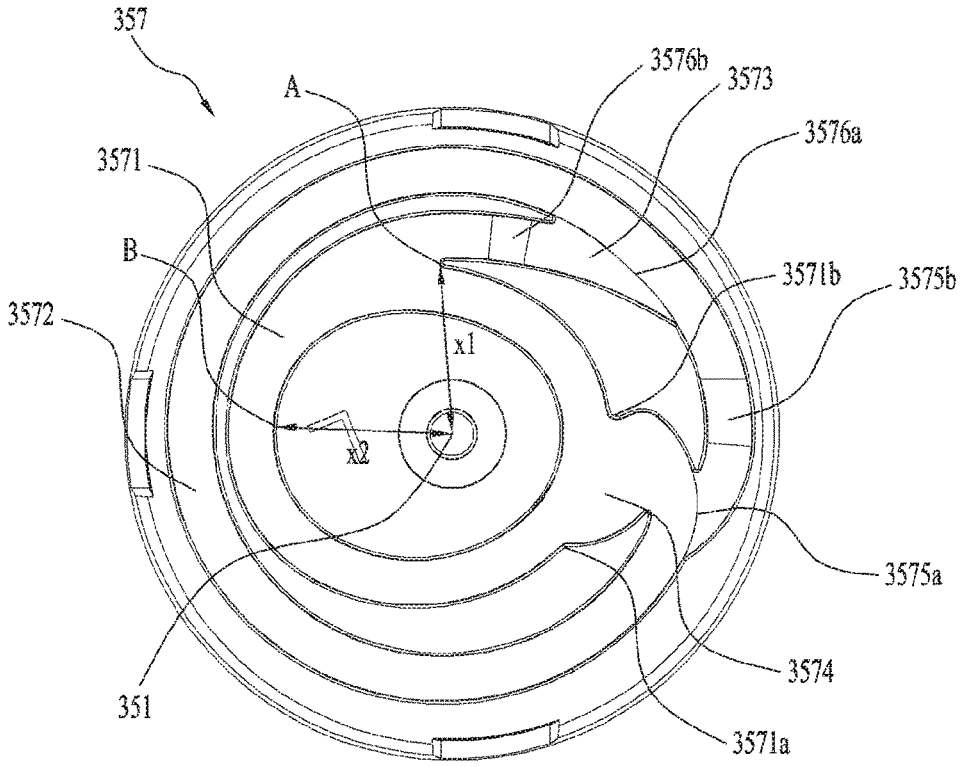
FIG. 9 is a view showing the shape of the track of the portable sound device according to an embodiment of the present invention.

FIG. 9 is a plan view of the track module 357 of the portable sound device according to an embodiment of the present invention. In the track module 357 shown in FIG. 9, rotation in the first direction, in which the sound cable is unwound, is referred to as "counterclockwise-direction rotation", and rotation in the second direction, in which the sound cable is wound on the bobbin 353, is referred to as "clockwise-direction rotation". However, the first direction may be the clockwise direction and the second direction may be the counterclockwise direction depending on the shape of the track module 357 and the reel spring 355. The following description will be given based on the shape of the track module 357 shown in the drawing for convenience of description.

The track module 357 includes two circular tracks 3571 and 3572, at the center of each of which the shaft 351 is located, a connection track 3573 interconnecting the circular tracks 3571 and 3572, and a stop track 3574. The first track 3571 and the second track 3572 have different diameters. The first track 3571 is located inside the second track 3572. The first track 3571 has an asymmetrical structure in which the distance of the first track 3571 from the shaft 351 is not uniform, but one side of the first track 3571 is located farther from the shaft 351.

Figure 14:
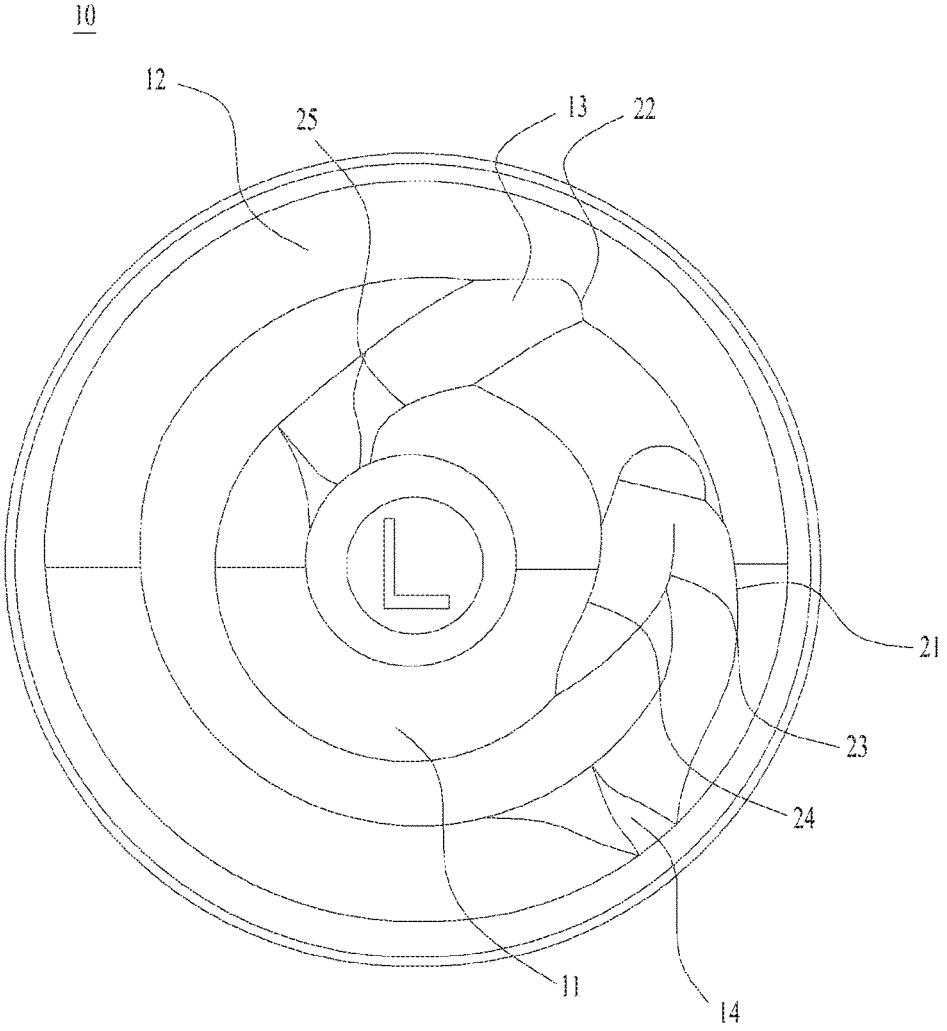
FIG. 14 is a view showing a track of a conventional portable sound device.

FIG. 14 is a view showing a conventional track 10. A first track 11 has a concentric circle, at the center of which a shaft is located. The first track 11 includes a step portion 25 that is inclined throughout a track surface and protrudes in the clockwise direction at the part thereof at which a connection track 13 is located. The step portion 25 of the first track 11 serves as a guide for guiding the stopper to move from the first track 11 to the connection track 13 when the track module is rotated in the counterclockwise direction. When the track module is rotated in the first track 11 in the clockwise direction, the track module moves from the high position to the lower position of the step portion 25, whereby the stopper may be continuously located in the first track 11.

Figure 10:
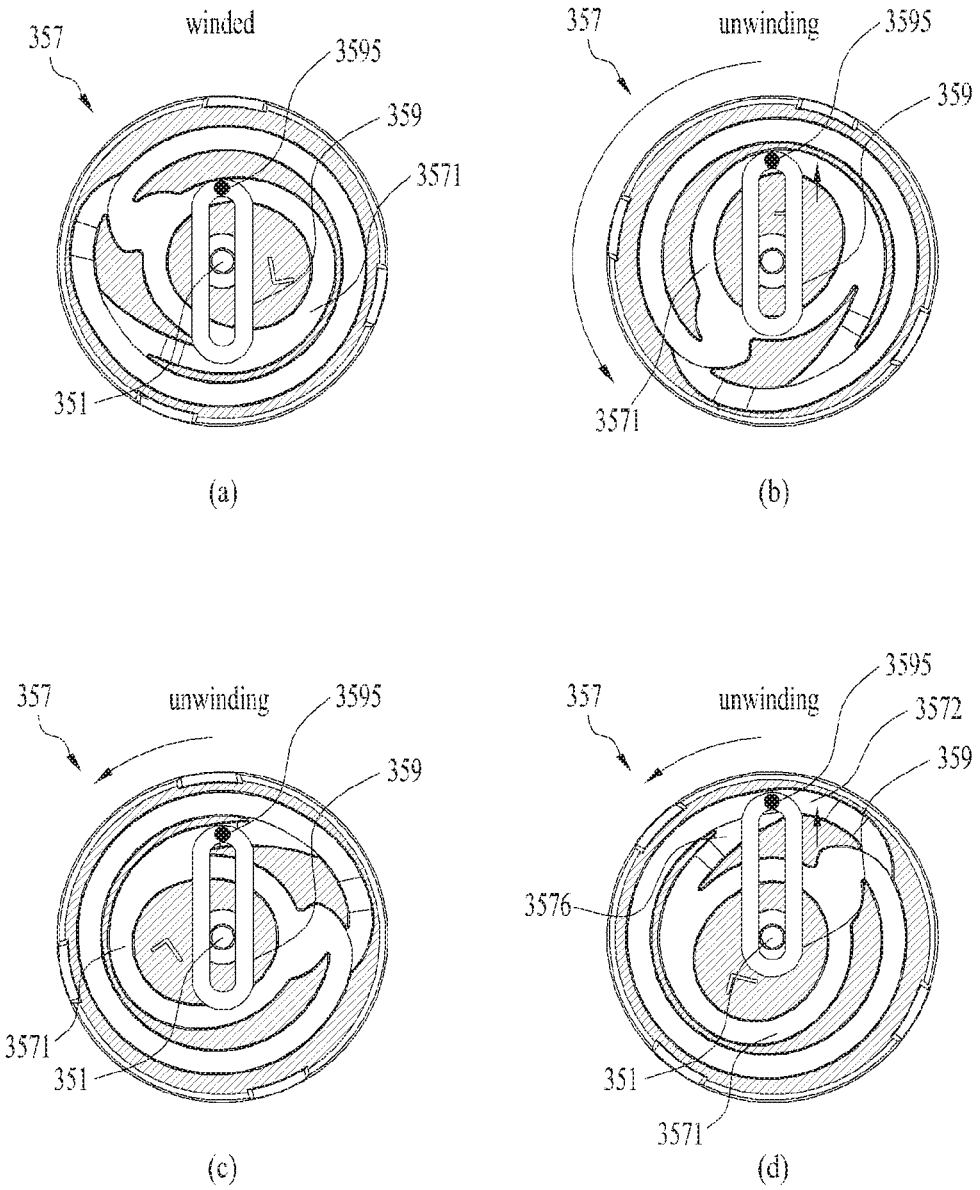
FIGS. 10, 11, and 13 are views illustrating various embodiments in which a stopper of the portable sound device according to the present invention moves along the track.

In contrast, the first track 3571 according to the present invention includes no inclined surface and no step portion, as shown in FIG. 9. The step portion or the inclined surface may be omitted from the first track 3571 according to the present invention, since the distance of the first track 3571 from the shaft 351 is not uniform. FIG. 10 is a view illustrating the relationship between the track module 357 and the stop plate 359 when the sound cable 345 is pulled so as to be withdrawn from the housing 320.

In the state in which the sound cable 345 is wound on the rotary module 350 (see FIG. 10(*a*)), the stopper 3595 is located in the first track 3571. When the user separates the earbud 340 from the earbud holder 325 and then pulls the earbud 340, the track module 357 is rotated in the counterclockwise direction, whereby the sound cable 345 is unwound. When the sound cable 345 is pulled, the track module 357 is rotated in the counterclockwise direction in the state in which the stopper 3595 is located in the first track 3571. The stopper 3595 passes through a second point B of the first track 3571, which is the farthest from the shaft 351 (see FIG. 10(*b*)), is located in the connection track 3573 (see FIG. 10(*c*)), passes through the connection track 3573, and is introduced into the second track 3572 (see FIG. 10(*d*)).

The first distance x1 from the shaft 351 to the first point A of the connection track 3573, which is the closest to the shaft 351, must be equal to or less than the second distance x2 from the shaft 351 to the second point B of the connection track 3573 ($x1 \leq x2$). In order for the stopper 3595 to be introduced into the connection track 3573 without being caught at the first point A when the rotary unit is rotated in the counterclockwise direction, the second distance x2 must be equal to or less than the first distance x1.

Since the position of the outer circumferential surface of the first track is uniform from the state shown in FIG. 10(*b*) to the state shown in FIG. 10(*c*), the stop plate 359 does not move rectilinearly, and the distance from the stopper 3595 to the shaft 351 is increased when the stopper 3595 is introduced into the second track 3572 along the connection track 3573. Consequently, the stopper 3595 moves rectilinearly so as to become distant from the shaft 351. The position of the shaft 351 in the shaft slot 3591 is biased in the direction opposite the direction in which the stopper 3595 is located (see FIG. 10(*d*)).

When the user continuously pulls the sound cable 345, the track module 357 is continuously rotated in the counterclockwise direction in the state in which the stopper 3595 is located in the second track 3572, as shown in FIG. 10(*d*). The second track 3572 is provided at the part thereof that is connected to the stop track 3574 with a first step portion 3575*a*, the height of which is increased in the counterclockwise direction. The second track 3572 includes a first inclined surface 3575*b* for compensating for the height of the first step portion 3575*a*. The first inclined surface 3575*b* may be located between the connection track 3573 and the stop track 3574 so as not to affect a second step portion 3576*a*, which is located between the connection track 3573 and the second track 3572.

When the rotary unit 350*b* is rotated in the counterclockwise direction, the rotary unit 350*b* may be rotated in the state in which the stopper 3595 is located in the second track 3572. When the rotary unit 350*b* is rotated in the clockwise direction, however, the stopper 3595 is caught by the first step portion 3575*a*, which is higher in the counterclockwise direction, whereby the stopper 3595 moves to the stop track 3574.

Figure 11:
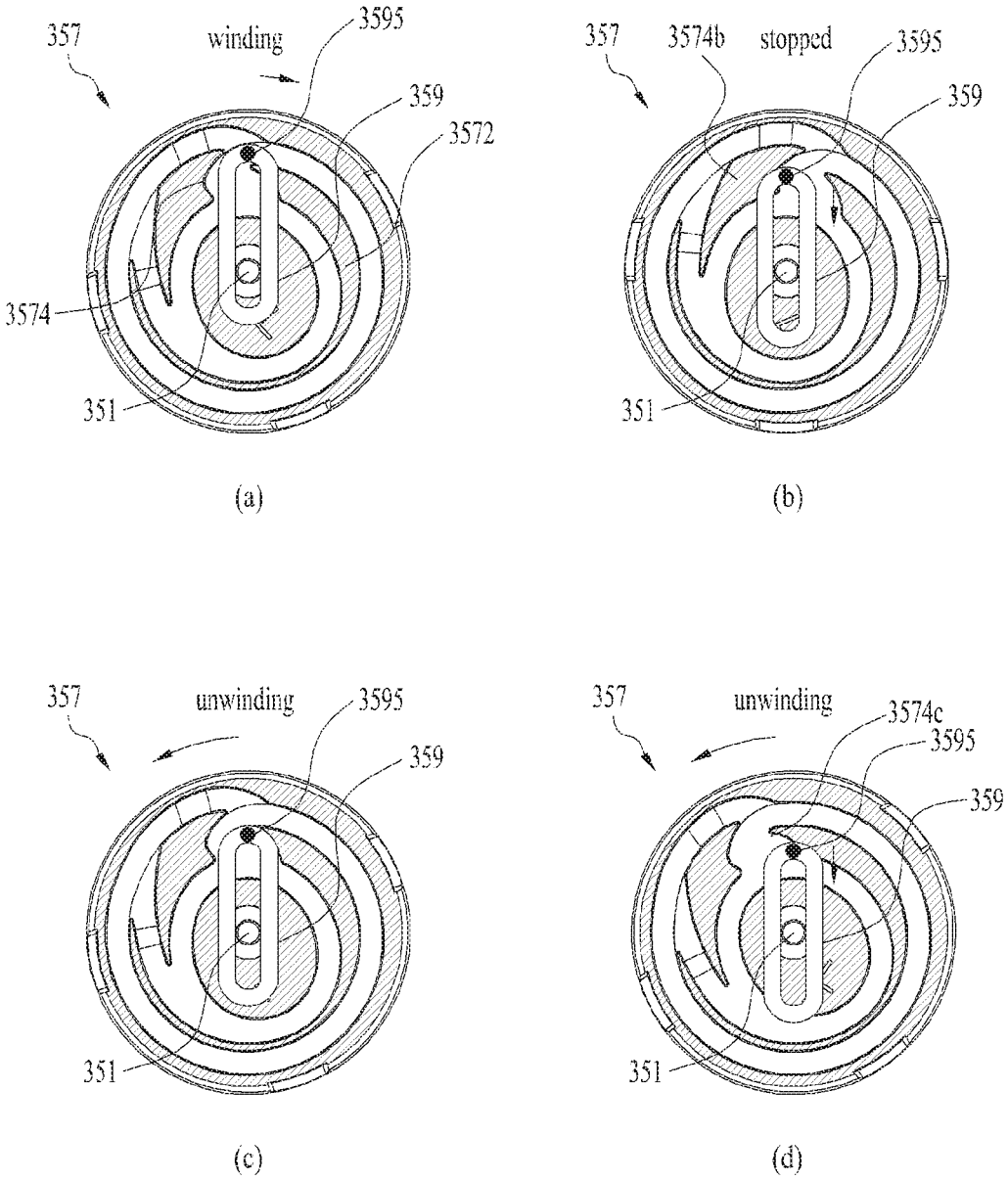
Figure 12:
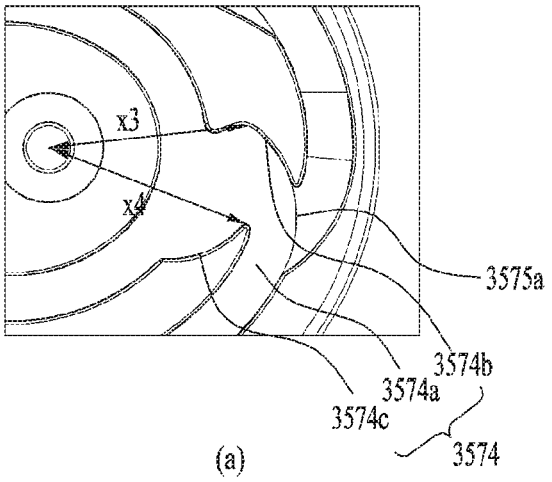
FIG. 12 is an enlarged view showing a stop track according to an embodiment of the present invention.
Figure 12:
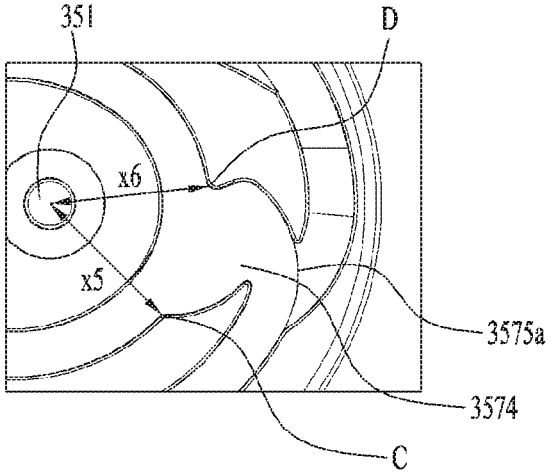

FIG. 11 shows the case in which the user releases the sound cable 345 while pulling the sound cable 345 (*a*), the case in which the rotation of the rotary module 350 is restricted (b), the case in which the user pulls the sound cable 345 again (c), and the case in which the fixed state of the rotary unit 350*b* is released (d). The stop track 3574 may include a first stop track 3574*a* connected to the second track 3572, the first stop track 3574*a* being bent in the shape of a V, a second stop track 3574*c* connected to the first stop track 3574*a*, and a fixing portion 3574*b*, at which the first stop track 3574*a* and the second stop track 3574*c* are connected to each other, the fixing portion 3574*b* being bent. FIG. 12 is an enlarged view of the stop track 3574. As shown in FIG. 12, the width of the stop track 3574 may not be uniform, but may vary.

In the case in which the user releases the sound cable 345 while pulling the sound cable 345 (see FIG. 11(*a*)), the stopper 3595 reaches the first step portion 3575*a*. At this time, the stopper 3595 moves along the first stop track

3574*a*. When the stopper 3595 reaches the fixing portion 3574*b*, the rotation of the track module 357 is stopped (see FIG. 11(*b*)).

When the user pulls the sound cable 345 again, the track module 357 is rotated in the counterclockwise direction, and the stopper 3595 escapes from the fixing portion 3574*b* of the stop track 3574 and moves to the first track 3571 along the second stop track 3574*c* (see FIGS. 11(*c*) and 11(*d*)).

Only in the case in which the distance x4 from the shaft 351 to the starting point of the second stop track 3574*c* is equal to or greater than the distance x3 from the shaft 351 to the fixing portion 3574*b*, as shown in FIG. 12(*a*), the stopper 3595 moves to the first track 3571 from the fixing portion along the second stop track 3574*c* (x3≤x4).

Referring to FIG. 14, a conventional stop track 14 also includes a step portion 23. In the present invention, however, the distances from the shaft 351 to the fixing portion of the stop track 3574 and to the starting point of the second stop track 3574*c* are set so as to have the above-described relationship such that the stopper 3595 is guided so as not to move to the first stop track 3574*a* but to move to the second stop track 3574*c* from the fixing portion.

When the user continuously pulls the sound cable 345, as shown in FIG. 10, the stopper 3595 is introduced again into the second track 3572 through the connection track 3573, and the track is rotated in the counterclockwise direction in the state in which the stopper 3595 is located in the second track.

Figure 13:
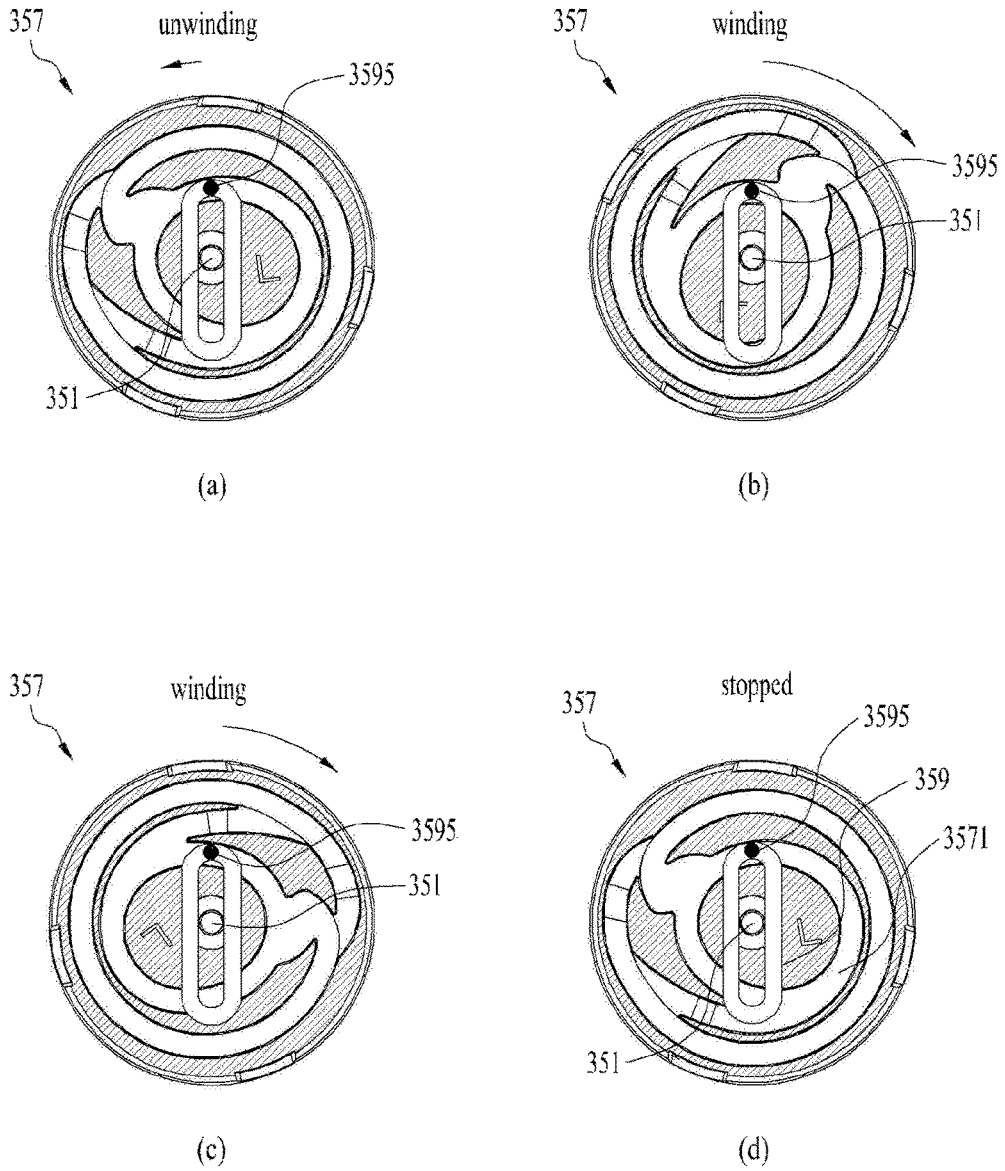

When the user slightly pulls the sound cable 345 and then releases the sound cable 345, as shown in FIG. 13, the track is rotated in the clockwise direction by the reel spring 355 in the state in which the stopper 3595 is located in the first track 3571 (see FIGS. 11(*a*), 11(*b*), and 11(*c*)). When the sound cable 345 is completely wound, the stopper 3595 is maintained in the state of being located in the first track 3571, as shown in FIG. 13(*d*).

In the conventional track 10, a step 24 is formed between the first track 11 and the stop track 14 in order to guide the stopper 3595 such that the stopper 3595 does not move from the first track 11 to the stop track 14 when the track 10 is rotated in the clockwise direction.

In contrast, according to the present invention, no step is formed between the first track 3571 and the stop track 3574, and the movement of the stopper 3595 from the first track to the stop track may be prevented based on the distance from the shaft 351 to the connection point of the stop track 3574 and the first track 3571. Referring to FIG. 12(*b*), the distance x5 from the shaft 351 to the front point C of the connection of the stop track 3574 and the first track 3571 in the counterclockwise direction may be set so as to be equal to or less than the distance x6 from the shaft 351 to the rear point D of the connection of the stop track 3574 and the first track 3571. When the track module 357 is rotated in the clockwise direction, the stopper 3595 may be rotated in the state of being continuously located in the first track 3571 without being caught at the rear point D or being introduced into the stop track 3574 from the front point C (x5≤x6).

As is apparent from the above description, the portable sound device according to the present invention has the following effects.

The number of members constituting the rotary module is reduced, whereby the thickness of the rotary module is reduced and thus the limited space is efficiently used.

In addition, the size of the step on the track surface is minimized, whereby soft rotation of the rotary module is achieved when the sound cable is inserted or withdrawn, and thus the usability of the portable sound device is improved.

Further scope of applicability of the present invention will become apparent from the detailed description given above. However, it should be understood that the detailed description and specific examples, while indicating preferred embodiments of the invention, are given by illustration only, since various changes and modifications within the spirit and scope of the invention will become apparent to those skilled in the art from this detailed description.

The above detailed description is not to be construed as limiting the present invention in any aspect, and is to be considered by way of example. The scope of the present invention should be determined by reasonable interpretation of the accompanying claims, and all equivalent modifications made without departing from the present invention should be included in the following claims.

What is claimed is:

1. A portable sound device comprising:

a main body having an audio output unit holder;

an audio output unit detachably mountable in the audio output unit holder and configured to output audio;

an audio cable configured to transmit an audio signal to the audio output unit, one end of the audio cable located outside the main body when the audio cable is connected to the audio output unit, and the other end of the audio cable located inside the main body; and a rotary module rotatably mounted in the main body and configured to wind or unwind the audio cable according to a rotational direction of the rotary module, wherein the rotary module comprises:

a stationary unit fixed to the main body, the stationary unit comprising a shaft;

a rotary unit configured to be rotatable about the shaft, the rotary unit comprising a track formed in a concave shape; and a stopper inserted into the track such that a position of the stopper varies in the track when the rotary unit is rotated, and wherein the track comprises:

a first track formed around the shaft, wherein a distance between one side of the first track and the shaft is different from a distance between another side of the first track and the shaft;

a second track located outside the first track;

a connection track interconnecting the first track and the second track; and a stop track located between the first track and the second track and bent in a shape of V.

2. The portable sound device according to claim 1, wherein a first distance from the shaft to a first point of the connection track, which is closest to the shaft, is equal to or shorter than a second distance from the shaft to a second point of the first track, which is farthest from the shaft.

3. The portable sound device according to claim 1, wherein:

the audio cable is wound when the rotary unit is rotated in a first direction;

the first track comprises no inclined surface and no step portion; and the second track comprises a first inclined surface, at which a height of a track surface of the second track gradually increases in the first direction, and a first step portion formed at a part of the second track at which the stop track is located, a height of the first step portion gradually decreasing in the first direction.

4. The portable sound device according to claim 3, wherein the first inclined surface is located between the connection track and the stop track.

5. The portable sound device according to claim 1, wherein the connection track comprises a second inclined surface, at which a height of a track surface of the connection track gradually increases from the first track to the second track, and a second step portion located between the connection track and the second track, the connection track being higher than the second track at the second step portion.

6. The portable sound device according to claim 1, wherein a height of a track surface of the stop track is uniform.

7. The portable sound device according to claim 1, wherein a third distance from the shaft to an outer track side of a V-shaped bent portion of the stop track is less than a fourth distance from the shaft to an inner track side of the V-shaped bent portion of the stop track.

8. The portable sound device according to claim 1, further comprising:

a stop plate located at an upper surface of the track, the stop plate comprising a shaft slot, through which the shaft extends, and the stopper protruding toward the track, wherein:

a width of the shaft slot corresponds to a width of the shaft; and a length of the shaft slot is equal to or greater than a difference in a distance between a point of the first track that is the closest to the shaft and a point of the second track that is the farthest from the shaft.

9. The portable sound device according to claim 8, wherein the rotary module further comprises:

a bracket fixed to the main body and configured to cover the stop plate, the bracket defining an external appearance of the rotary module;

a guide slot formed in the bracket, the guide slot extending in a direction parallel to a longitudinal direction of the shaft slot; and a guide boss formed at the stop plate and configured to be inserted into the guide slot.

10. The portable sound device according to claim 9, wherein the guide boss and the stopper are formed symmetrically in a thickness direction of the stop plate.

11. The portable sound device according to claim 8, wherein the stop plate moves rectilinearly in a direction in which the shaft slot is formed when the rotary unit is rotated.

12. The portable sound device according to claim 1, wherein the rotary unit further comprises:

a bobbin configured to be rotatable about the shaft such that the audio cable is wound on an outer circumferential surface of the bobbin; and a reel spring configured to provide rotary force to the bobbin, the reel spring having one end coupled to the bobbin and the other end fixed to the shaft.

13. The portable sound device according to claim 1, wherein the audio output unit comprises an in-ear audio device.

14. The portable sound device according to claim 13, wherein the in-ear audio device comprises an earbud.

15. A portable sound device comprising:

a main body having an audio output unit holder;

an audio output unit detachably mountable in the audio output unit holder and configured to output audio;

an audio cable coupled to the audio output unit and configured to transmit an audio signal to the audio output unit, one end of the audio cable located outside the main body and the other end of the audio cable located inside the main body; and a rotary module rotatably mounted in the main body and configured to wind or unwind the audio cable according to a rotational direction of the rotary module, wherein the rotary module comprises:

a stationary unit fixed to the main body, the stationary unit comprising a shaft;

a rotary unit configured to be rotatable about the shaft, the rotary unit comprising a track;

a stopper inserted into the track such that a position of the stopper varies in the track when the rotary unit is rotated; and a stop plate located at an upper surface of the track, the stop plate comprising a shaft slot, through which the shaft extends, and the stopper protruding toward the track, wherein the track comprises:

a first track formed around the shaft such that a distance of the first track from the shaft is inconsistent;

a second track located outside the first track;

a connection track interconnecting the first track and the second track; and a stop track located between the first track and the second track, and wherein:

a width of the shaft slot corresponds to a width of the shaft; and a length of the shaft slot is equal to or greater than a difference in a distance between a point of the first track that is the closest to the shaft and a point of the second track that is the farthest from the shaft.

16. The portable sound device according to claim 15, wherein the stop track is curved or in a bent shape.

17. The portable sound device according to claim 15, wherein the stop track is bent in a shape of V.

* * * * *